United States Patent [19]

Gyomrey

[11] 4,392,573

[45] Jul. 12, 1983

[54] TIE ROPE COMPENSATION ARRANGEMENT

[75] Inventor: Karl M. Gyomrey, Belmont, England

[73] Assignee: Coles Cranes Limited

[21] Appl. No.: 179,307

[22] Filed: Aug. 18, 1980

[30] Foreign Application Priority Data

Aug. 17, 1879 [GB] United Kingdom ..... 7928798

[51] Int. Cl.[3] ..... B66C 23/04

[52] U.S. Cl. ..... 212/230; 212/264; 212/267

[58] Field of Search ..... 212/230, 231, 264, 267, 212/268; 52/118

[56] References Cited

U.S. PATENT DOCUMENTS

| | | | |
|---|---|---|---|
| 2,819,803 | 1/1958 | Obenchain | 212/264 |
| 2,999,600 | 9/1961 | Gates | 212/231 |
| 3,194,413 | 7/1965 | Landry | 212/264 |
| 3,371,799 | 3/1968 | Brownwell et al. | 212/230 |
| 3,534,867 | 10/1970 | Johnston et al. | 212/264 |
| 3,856,151 | 12/1974 | Lamer | 212/268 |

FOREIGN PATENT DOCUMENTS 1262553 2/1972 United Kingdom .

*Primary Examiner*—Sherman D. Basinger
*Attorney, Agent, or Firm*—Townsend & Townsend

[57] ABSTRACT

A telescopic strut jib crane includes a jib with at least three telescopic sections and at least one tie rope of fixed length. The rope is fed between the head of the base section and head of the outer section around a pulley at the foot of an intermediate telescopic jib section. One end of the tie rope (12) passes around a support pulley (14) to the rear of the jib around first extension pulley (32) at the head of the outermost jib section (2), down the outermost jib section, around a second extension pulley (28) at the foot of the outermost section, to be anchored at or adjacent (26) the head of the intermediate jib section (4). The other end of the tie rope (12) extends from the support pulley (14) around a third extension pulley (34) at the head of the intermediate section (4), down the intermediate section and around fourth extension pulley (36) at the base of said intermediate section (4), and then to the head of the adjacent lower section (6).

7 Claims, 4 Drawing Figures

TIE ROPE COMPENSATION ARRANGEMENT

BACKGROUND OF THE INVENTION

This invention relates to cranes and in particular to cranes of the strut type having a jib which is normally of lattice or lightweight construction, which is pivoted to a platform or the like (which may form part of a mobile crane vehicle or which may be mounted in a fixed location), the head of the jib being supported by tie "ropes" to enable the jib to carry the required load and to be "derricked" up and down.

If, which is particularly desirable, when the crane is a mobile crane, the jib of a crane of this type comprises a number of telescopic sections, then when the telescopic sections are moved outwardly to extend the jib, the tie "ropes" must also be extended so as to maintain the jib angle. Otherwise the jib is pulled initially to a more vertical position and, subsequently, further extension of the jib is prevented by the tie "ropes".

Compensation for jib tie "ropes" during telescopic extension of the jib to prevent jib elevation is provided for in our U.K. Pat. No. 1,262,553 (Inventor: Valentine W. Burney) which will be referred to hereinafter as "our former British patent".

In the jib arrangement of our former British patent, the tie rope or derrick rope as it is called in that patent extends from a point adjacent the top or head of the outer section of the jib, around the head and then middle of the derrick mast to the head of the inner section of the jib to pulleys at the foot of the intermediate jib section and thence back to the head of the inner section jib. Thus the intermediate section is partly supported by the jib tie rope when the jib is in its extended position, but only the intermediate section is so supported, and support of the outer section of the jib relies entirely on the telescoping means. As telescoping cranes increase in length so the problems due to weight and stress increase and the problem is now to provide better support for the outer section of the jib when this is extended.

SUMMARY OF THE INVENTION

A telescopic strut jib crane in accordance with this invention comprises a jib with at least three telescopic sections, a tie rope or ropes of fixed length which rope or ropes are fed between the head of the base section and head of the outer section around pulley means carried on the foot of an intermediate telescopic jib section, the invention being characterised in that the tie rope or ropes pass around support pulley means to the rear of the jib around first extension pulley means at the head of the outermost jib section down the outermost section, around second extension pulley means at the foot of the outermost section, to be anchored or adjacent the head of an intermediate section, the other end of the tie rope or ropes extending from said support pulley means around third extension pulley means at the head of said intermediate section down said intermediate section and around fourth extension pulley means at the base of said intermediate section to the head of the adjacent lower section.

Preferably, anchorage of the tie rope or ropes at the other end is at the foot of the jib section immediately adjacent the base section and the tie rope or ropes then extend to a fifth extension pulley means at the head of the base section. Two tie ropes are normally provided one each side of the jib. The tie rope or ropes may pass down each jib section within or alongside each section.

In the case of there being three jib sections, the tie rope or ropes extend from the fifth extension pulley means to the fourth extension pulley means.

With such an arrangement, if the outermost section telescopes into the second section, then a length of tie rope equivalent to the length of the portion of the outermost section moving into the second section, is taken up within the second section. Also when the second or intermediate section is telescoped into the base section, two lengths of tie rope equivalent to the telescoping movement of both the second and outermost section are taken up within the base section.

Normally, as a telescopic jib is loaded, the load would tend to increase the tension in the tie ropes and would also tend to push the jib sections together applying an increasing load on the rams or other means for extending the sections. With a tie rope compensation device as defined above, the increase in tension in the tie ropes due to the load tends to cause the jib sections to extend out from each other and also to pull the jib more upright. This therefore provides load compensation for the jib.

Equally, the weight of the jib sections as they are moved outwardly from each other tends to increase the tension in the tie ropes, but due to the load compensation arrangement, this increase in tension in the tie ropes helps to urge the jib sections outwardly. Hence, the means for moving the sections inwardly and outwardly needs to be of very much reduced power, as compared to a telescopic jib without a tie rope compensation arrangement.

The support pulley or sheave around which each tie rope passes and which is arranged to the rear of the jib is preferably provided at the head of a derrick mast, the lower end of the mast being pivoted to a fixed surface (which may form part of a mobile crane) the angle of the derrick mast being determined by a ram acting between the mast and a fixed point. With such an arrangement, the angle of the derrick mast can readily be adjusted altering the angle of the jib.

BRIEF DESCRIPTION OF THE DRAWINGS

An embodiment of the invention will now be further described by way of example with reference to the accompanying drawing, in which.

DETAILED DESCRIPTION OF THE PREFERRED EMBODIMENT

Figure 1:
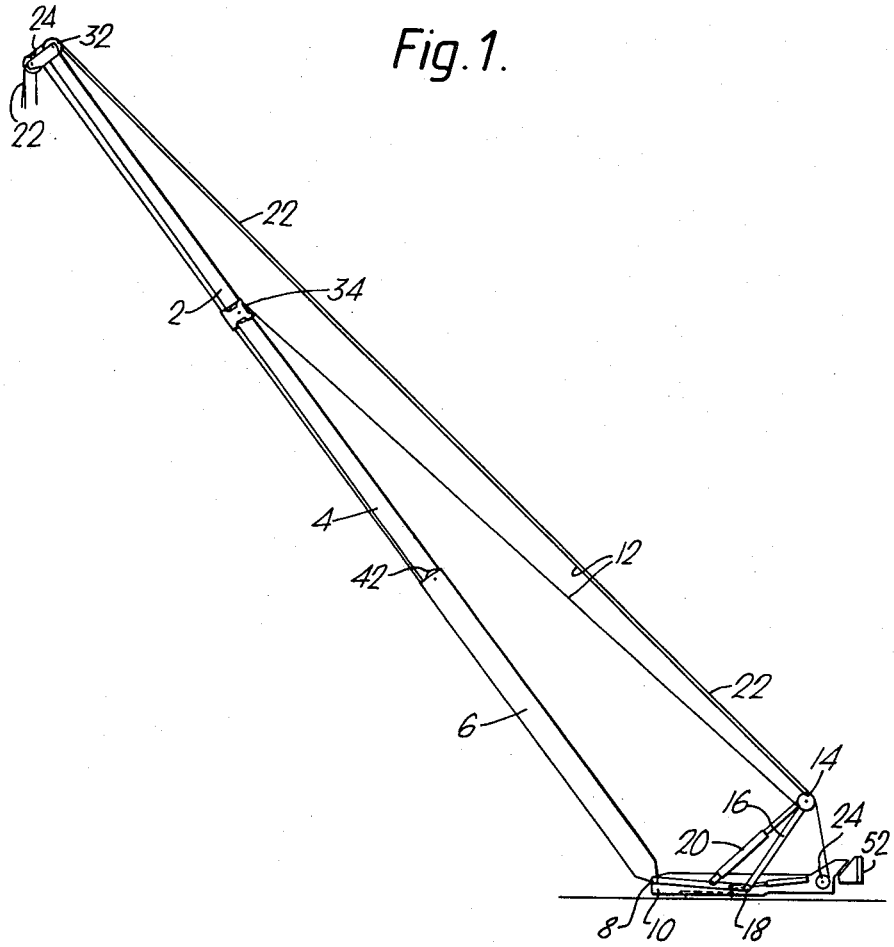
FIG. 1 is a diagrammatic view of an embodiment of a telescopic strut jib in accordance with the invention showing the jib in its erected position.

Referring to FIG. 1, the crane jib is a "strut" jib formed of three telescopic sections, namely, a head section 2, an intermediate section 4 and a base section 6. The base section 6 is pivotally mounted at 8 to a turntable platform 10 which may be rotatably mounted in a fixed position or which may form part of a mobile crane vehicle such as that illustrated in FIG. 3.

A mobile crane having such a telescopic strut jib forms the subject of our co-pending application Ser. No. 179,616, (now abandoned and continued as application Ser. No. 418,134, filed Sept. 15, 1982) filed co-terminously herewith.

Figure 2:
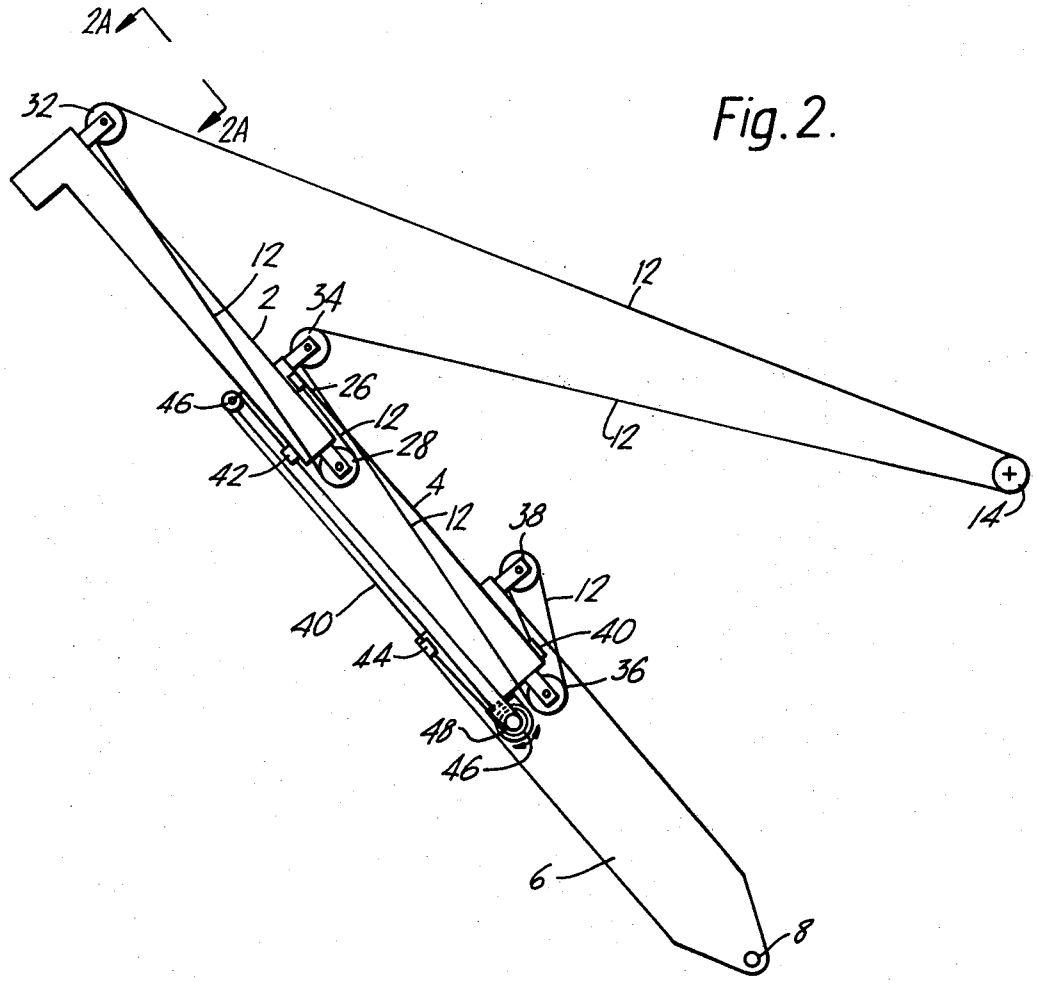
FIG. 2 is a diagram of the jib of FIG. 1 showing the arrangement of the tie ropes within the jib sections providing tie rope compensation.
Figure 2A:
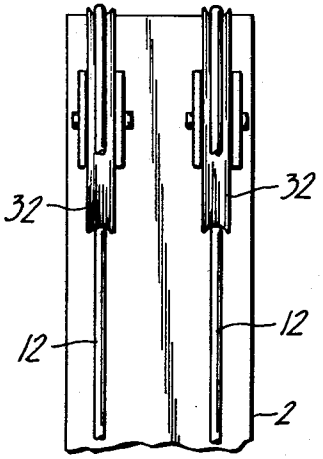
FIG. 2A is taken along 2A—2A in FIG. 2.

The strut jib is supported by two tie "ropes" 12 (see FIG. 2A) of fixed length one at each side of the jib and only one of which is shown in FIG. 2. Each tie "ropes" (which may be made of any convenient material) passes around a support pulley or sheave 14 carried at one end of a derrick mast 16 the other end of which is pivotally mounted at 18 to the turntable 10.

The angle of the mast 16 to the turntable 10 and hence the angle of the jib is determined by an adjustable ram 20 pivotally connected between the turntable and the head of the derrick mast 16.

A standard hoist rope 22 extends from a hoist 24 on the turntable around a sheave at the head of the derrick mast 16 around pulleys 24 at the head of the outer section 2 of the jib for connection to a standard crane hook or the like (not shown).

As can be seen in FIG. 2, one end of each tie rope 12 is anchored at 26 within the intermediate jib section 4 at a point adjacent the head of that section. The tie rope then extends around a pulley or sheave 28 extending down from, and carried by, the inner end of the outermost jib section 2 up within the jib section 2, and around a second pulley 32 extending out from, and carried by, the head of the head section 2 of the jib.

The tie rope then passes around the support pulley or sheave 14 carried by the head of the derrick mast 16, jib and then around a pulley 34 extending out from, and carried by, the head of the second or intermediate jib section 4. The tie rope 12 then passes down the second jib section and out from the bottom thereof, around a pulley 36 extending from, and carried by, the inner end of the second jib section.

The tie rope finally passes out from the base section 6 around a further pulley 38 extending out from, and carried by, the head of the base section 6 of the jib, to an anchor point 40 at the lower end of the intermediary or second jib section 4.

When the head or outermost jib section 2 is telescoped into the intermediate section 4, by standard means (not shown) or by the means described hereafter, the length of tie rope extending between the pulley 28 and the anchor point 26 is extended to compensate for the extent of telescopic movement of the head jib section 2 within the intermediate jib section 4. Equally, when the section 4 is telescoped into the base section 6, the length of tie rope extending between the pulleys 36 and 38 is extended to compensate for the movement of the two sections together. The length of tie rope between the pulley 38 and the anchor 40 also increases to compensate for the movement of the jib section 2 towards the base section 6. Thus the length of tie rope extending between the support pulley 14 at the derrick mast head, and the pulleys 32 and 34 is reduced to compensate for the shorter jib length whilst maintaining the angle of the jib approximately constant.

Equally, when the jib sections are extended the length of tie rope taken up within the jib sections is reduced allowing the length of jib ropes between the pulleys 32, 34 and 14 to extend, again maintaining the jib angle approximately constant.

When the jib is subjected to load, the load increases the tension in the tie ropes 12 and this increase in tension, as can readily be appreciated from FIG. 2, acts to urge the jib sections to move out from each other which compensates for the tendency of the applied load to drive the jib sections back within each other.

When the jib sections are being telescoped outwardly, it will be appreciated that the further the extension, the greater the tension in the tie rope 12 and the greater the tension, the greater the force supplied by the tie ropes on the pulleys 28 and 38 tending to move the sections outwardly. This arrangement therefore means that the means provided to move the jib sections outwardly need be far smaller than what otherwise would be the case.

It will be appreciated that the tie ropes 12 support the jib both at the head of the outer or head jib section 2 and at the head of the intermediate or second jib section 4. This supports the jib, when fully extended, both at its head and at a point about ⅔'s of its length. This counteracts bending stresses in the jib and helps to enable the jib to be of lighter weight than would otherwise be the case.

As the tie ropes are of fixed length, then for any given load, extension of the derrick mast ram 20 causes the derrick mast 16 to swing rearwardly (clockwise as shown in FIG. 1) to derrick the jib to a more vertical position. Equally, contraction of the ram 20 allows the jib to move downwardly (anti-clockwise as seen in the drawing). It is found that this provides a far more satisfactory and less complicated derrick jib movement than does a device for winching the tie ropes to derrick the jib.

As the tie rope/load compensation arrangement as described above helps to compensate for increasing load on the jib sections, the jib sections may be moved inwardly and outwardly either by a relatively small ram or rams, as is conventional, or by means of a chain 40 anchored at 42, 44 to the head and base sections respectively and passing around two pulleys 46 one at each end of the intermediately section, the pulley 46 at the inner end being driven by a motor 48 as fully described in the specification of our co-pending application Ser. No. 179,360 filed co-terminously herewith, now U.S. Pat. No. 4,363,413.

Figure 3:
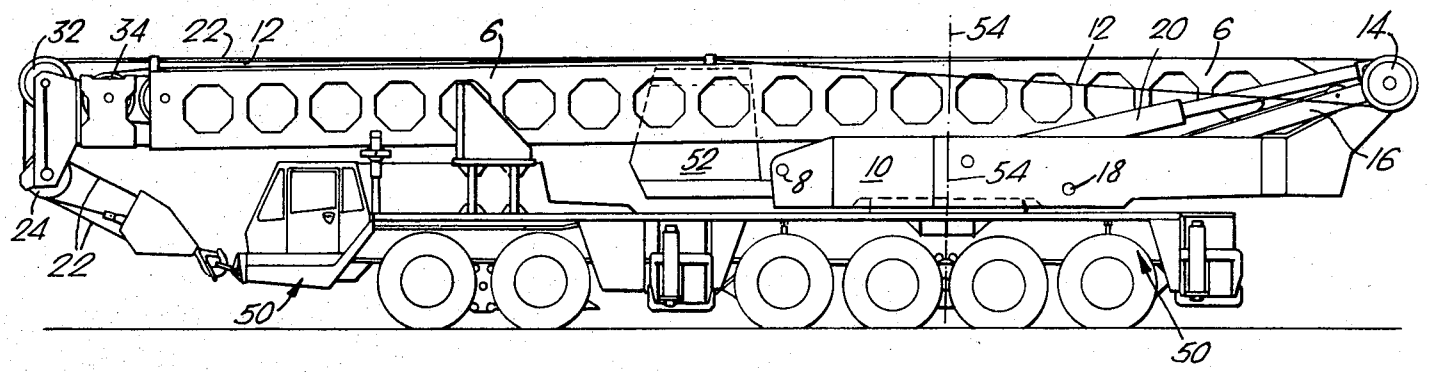
FIG. 3 is an elevation of a mobile crane including the jib illustrated in FIGS. 1 and 2.

FIG. 3 illustrates the jib structure as carried on a mobile crane vehicle 59 with the jib sections telescoped together. A counterweight 52 is shown in FIG. 1 positioned at the rear of the turntable 10 for use in FIG. 3 in its stowed position for travel. The turntable 10 is mounted on the vehicle for rotation about axis 54 to slew the jib. The counterweight 52 and its mounting is fully described in the specification of our co-pending application Ser. No. 179,616 (now abandoned and continued as application Ser. No. 418,134, filed Sept. 15, 1982)filed co-terminously herewith.

I claim:

1. A telescopic strut jib crane comprising:

a crane base, a turntable pivotally mounted to said base, a jib mounted to said turntable so as to be able to elevate or lower about a pivot at the base of the jib, said jib comprising at least three telescopic sections, each section telescoping one within the next adjacent telescopic station said sections comprising an outer section, at least one intermediate section and a base section, telescope means for extending telescopically jib sections from said base section, support pulley means mounted to said turntable to the rear of said jib, tie rope means of fixed length, said rope means passing from an anchorage at the head of said intermediate section to and around first extension pulley means at the base of said outer section to and around second extension pulley means at the head of said outer section to and around said support pulley means to and around third extension pulley means at the head of said intermediate section down said intermediate section and around fourth extension pulley means at the base of said intermediate section and to the head of the adjacent lower section, whereby each said section is supported by said rope means from said support pulley means.

2. A crane as claimed in claim 1 wherein the tie rope means has first and second ends, said first end at said anchorage at the head of said intermediate section and said second end at the foot of the intermediate section immediately adjacent the base section, the tie rope means then extending to a fifth extension pulley means at the head of the base section.

3. A crane as claimed in claim 2 wherein there are three telescopic sections, the tie rope means extending from the fifth extension pulley means to the fourth extension pulley means.

4. A crane as claimed in claim 1 wherein said tie rope means comprises two tie ropes, one said rope being provided on each side of said jib.

5. A crane as claimed in claim 1 wherein the support pulley means is provided at the head of a derrick mast, the lower end of the mast being pivotally mounted to the crane turntable.

6. A crane as claimed in claim 5 wherein the derrick mast is raised or lowered by a hydraulic ram acting between the mast and the turntable.

7. A crane as claimed in claim 1 wherein said crane base comprises the chassis of a mobile crane vehicle.

* * * * *